US005595787A

United States Patent [19]

Kistrup et al.

[11] Patent Number: 5,595,787

[45] Date of Patent: Jan. 21, 1997

[54] CHEMICAL METALLIZATION OF ELECTRICALLY NON-CONDUCTING POROUS SUBSTRATES

[75] Inventors: Holger Kistrup, Esslingen; Otwin Imhof, Nürtingen, both of Germany

[73] Assignee: Deutsche Automobilgesellschaft mbH, Germany

[21] Appl. No.: 751,641

[22] Filed: Aug. 26, 1991

Related U.S. Application Data

[63] Continuation of Ser. No. 553,622, Jul. 18, 1990, abandoned.

[30] Foreign Application Priority Data

Jul. 29, 1989 [DE] Germany ..... 39 25 232.9

[51] Int. Cl.[6] ..... B05P 3/04

[52] U.S. Cl. ..... 427/304; 427/305; 427/306; 427/437; 427/443.1

[58] Field of Search ..... 427/437, 443.1, 427/304, 305, 306

[56] References Cited

U.S. PATENT DOCUMENTS

| | | | |
|---|---|---|---|
| 3,914,520 | 10/1975 | Hovey | 427/306 |
| 3,967,010 | 6/1976 | Maekawa | 427/306 |
| 4,002,779 | 1/1977 | Nischwitz | 427/306 |
| 4,201,825 | 5/1980 | Ebneth | 427/306 |
| 4,315,045 | 2/1982 | Dillard | 427/306 |
| 4,335,164 | 6/1982 | Dillard | 427/306 |
| 4,645,573 | 2/1987 | Orban | 427/306 |
| 4,716,055 | 12/1987 | Sanders | 427/306 |
| 4,720,400 | 1/1988 | Manniso | 427/305 |
| 4,835,015 | 5/1989 | Kistrup | 427/306 |
| 4,925,706 | 5/1990 | Kistrup | 427/305 |
| 5,089,301 | 2/1992 | Kistrup | 427/304 |

FOREIGN PATENT DOCUMENTS

| | | | |
|---|---|---|---|
| 2749151 | 5/1979 | Germany | 427/306 |
| 2196651 | 5/1988 | United Kingdom | 427/304 |
| 2225028 | 5/1990 | United Kingdom | 427/304 |

*Primary Examiner*—Benjamin Utech

*Attorney, Agent, or Firm*—Evenson, McKeown, Edwards & Lenahan P.L.L.C.

[57] ABSTRACT

A chemical metallization process is used for electrically non-conducting porous substrates, in needle felts, nonwovens or open-pored foams which possesses a porosity of from 40 to 97%. The metallization follows activation of the fiber surfaces or of the surfaces of the pore walls with a noble metal-containing solution. The volume of the chemical metallizing solution used is reduced to produce a considerable reduction in the operating costs, not only in respect of the solution itself but also in respect of the disposal of the waste water from the chemical metallization. Since less waste water is produced from the start in the chemical metallization process, a considerable contribution to the protection of the environment results.

9 Claims, No Drawings

CHEMICAL METALLIZATION OF ELECTRICALLY NON-CONDUCTING POROUS SUBSTRATES

This application is a continuation of U.S. patent application Ser. No. 07/553,622, filed Jul. 18, 1990, now abandoned.

BACKGROUND AND SUMMARY OF THE INVENTION

The present invention relates to a process for chemical metallization of electrically non-conducting porous substrates, and, in particular, for substrates such as needle felts, nonwovens or open-pored foams, following a preceding activation of the fiber surfaces or of the surfaces of the pore walls with a noble metal-containing solution. The electrically non-conducting porous substrates with which the present invention is used have a porosity of from 40 to 97%.

In the chemical metallization of porous non-wovens, needle felts or open-pored foams, it has been customary to subject fiber surface (in the case of nonwovens or needle felts) or the pore walls (in the case of open-pored foams) of non-conducting plastic to a two-step chemical treatment, namely first activation and then the actual chemical metallization.

The activation step customarily comprises depositing a noble metal-containing chemical compound on the substrate surface. This noble metal-containing compound functions as a catalyst in the subsequent chemical metallization. Suitable noble metal-containing catalytically active compounds for activating plastics surfaces are in particular those which are prepared on the basis of palladium/tin compound.

Following activation, the plastics surface is ready for chemical metallization after the excess/spent activating solution has been removed from the pores of the non-woven, needle felt or open-pored form. In practical terms, the chemical metallization is effected by filling the pores with a chemical metallizing solution and then leaving the plastics substrate to be metallized in contact with the metallizing solution until metallization is complete. Outward signs for completion of the metallization are the subsidence of the hydrogen evolution which accompanies the chemical metallization or, quite simply, the disappearance of the color of the dissolved metallization from the solution.

Fundamental observation on the topic of activation and chemical metallization can be found, for example, in Kunststoff-Galvanisierung, Hdb. für Theorie und Praxis (Leuze Verlag, Saulgau/Württ) and also, in U.S. Pat. No. 3,011,920. In this field, chemical nickelization and chemical coppering are undoubtedly the most important processes, although other chemical metal depositions are also possible. The porosity of the plastic substrates to be metallized is in general between 40 and 97%.

Suitable plastics materials for the nonwovens, needle felts or open-pored foams to be metallized are, in particular, polyethylene, polyester and polyamide. The appropriate technical procedure is described for example in Design Pat. Nos. 3,631,055; 3,637,130; and 3,710,895. U.S. Pat. No. 4,720,400 also describes the activation and chemical metallization of a microporous polytetrafluoroethylene substrate.

In practice, the volume of the metallizing solution for the activated substrates is always larger than the free (i.e. fillable) pore volume or the woven, needle felt of open-pored foam. This means that the volumes of the metallizing solutions used, which are frequently only used once, are relatively large. This results, on the one hand, in high operating costs for the metallizing solutions used and, on the other hand, in greater expense in relation to the waste waters to be disposed of or a high degree of environmental pollution if the waste waters are not disposed of adequately.

It is thus an object of the present invention to provide a process for the chemical metallization of electrically non-conducting porous substrates, in particular needle felts, nonwovens or open-pored foams, following a preceding activation of the fiber surfaces or of the surfaces of the pore walls, with a noble metal-containing solution requiring fewer industrial resources and having a less harmful on the environment.

This object is achieved according to the present invention by effecting chemical metallization of activated electrically non-conducting substrates by adding a volume of metallization which is less than the free pore volume of the porous substrate. In other words, the metallization of activated open-pored foams, non-wovens or needle felts, occurs by using less of the chemical metallizing solution than corresponds to the arithmetic open pore volume of the textile or foam, and to be precise, sufficiently less by an amount which takes into account that the volume of the metallizing solution will increase during the chemical metallization process due to the evolution of hydrogen.

The accompanying evolution of hydrogen also ensures a thorough mixing of the solution and,hence, also ensures that the pores which at the start of the metallization reaction were not as yet filled with solution in the course of the metallization. The volume of metallizing solution to be used does, of course, also depend on reaction parameters such as the concentration of the dissolved salts, the temperature and the density and activity of the noble metal particles previously deposited in the course of the activation. As a rule of thumb, a nickelization at room temperature can be carried out with a volume of metallizing solution at least 10% less than the arithmetic pore volume of the open-pored foam, non-woven or needle felt.

DETAILED DESCRIPTION OF A PRESENTLY PREFERRED EMBODIMENT

The present invention will now be further described in detail with reference to an example of a presently preferred embodiment:

A length of polypropylene fiber felt 2 mm in thickness with a porosity of 89% was first activated with a Pd/Sn-containing solution, arranged in four superposed layers, and then placed in a metallizing tank. The thickness of the superposed felt layers to be nickelized thus was about 8 mm. A chemical nickelizing solution (36 g of nickel chloride hexahydrate/1, 78 g of sodium hypophosphite monohydrate/1, 95 g of ammonium chloride/1, 36 g of sodium hydroxide/1) was applied to these felt layers in such a way that the solution was about 7 mm deep before the start of the metallization reaction. Shortly after the start of the reaction, the level of the nickelizing solution rose to such an extent that even the uppermost felt layer became impregnated with solution. After the chemical nickelization had ended, the uppermost layer of needle felt had been chemically nickelized as efficiently and as uniformly as the lower layers which has been completely filled from the start with metallizing solution in the pores.

The advantages of the process according to the present invention are, in particular, that less chemical metallizing solution needs to be prepared and used. This then also results in a lower amount of waste water to be disposed of or, in the absence of effective waste disposal, less environmental pollution. The overall effect is thus to reduce operating costs of the process of chemical metallization of previously activated electrically non-conducting plastics substrates.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for chemical metallization of electrically non-conducting porous needle felt substrates having a porosity of from 40 to 97%, comprising the steps of activating fiber surfaces of the substrates with a noble metal-containing solution, placing the activated substrates in at least four layers, one above the other, in a metallizing tank whereby the lower layers are immediately brought into contact with a chemical metallizing solution and the remaining layers are initially not filled with the chemical metallizing solution and chemically metallizing the activated substrates by adding an initial volume of the chemical metallizing solution which is from 10 to 30% less than the free pore volume of the substrates and thereafter increasing the initial volume by evolution of gas to fill the remaining layers.

2. The process according to claim 1, wherein the porous substance are coppered with the chemical metallizing solution.

3. The process according to claim 1, wherein the porous substrates are nickelized with the chemical metallizing solution.

4. The process according to claim 1 wherein the electrically non-conducting porous substrates are selected from the group consisting of polyethylene, polyester, polyamide and polyacrylonitrile fibers.

5. A process for chemical metallization of electrically non conducting, open-pore substrates having a porosity of from 40 to 97%, comprising the steps of activating pore wall surfaces of the substrates with a noble metal containing solution, placing the activated substrates in at least four layers, one above the other, in a metallizing tank whereby the lower layers are immediately brought into contact with a chemical metallizing solution and the remaining layers are initially not filled with the chemical metallizing solution, and chemically metallizing the activated substrates by adding an initial volume of the chemical metallizing solution which is from 10 to 30% less than the free pore volume of the substrates and thereafter increasing the initial volume by evolution of gas to fill the remaining layers.

6. The process according to claim 5, wherein the porous substrates are coppered with the chemical metallizing solution.

7. The process according to claim 5, wherein the porous substrates are nickelized with the chemical metallizing solution.

8. The process according to claim 5, wherein the electrically non-conducting porous substrates are selected from the group consisting of polyethylene, polyester, polyamide and polyacrylonitrile fibers.

9. A process for chemical metallization of electrically non-conducting porous needle felt and of non-woven substrates having a porosity of from 40 to 97%, comprising the steps of activating fiber surfaces of the substrates with a noble metal-containing solution, placing the activated substrates in at least four layers, one above the other, in a metallizing tank, bringing said substrates into contact with a chemical metallizing solution with an initial volume of the chemical metallizing solution which is from 10 to 30% less than the free pore volume of the substrates whereby only the lower layers are immediately into contact with a chemical metallizing solution and the remaining layers are initially not filled with the chemically metallizing solution and thereafter chemically metallizing all the activated substrates by increasing the initial volume by evolution of gas to fill also the remaining layers.

* * * * *